US011179759B2

(12) United States Patent
Werner et al.

(10) Patent No.: US 11,179,759 B2
(45) Date of Patent: Nov. 23, 2021

(54) SYSTEM AND METHOD FOR REMOVING FLATNESS FAULTS FROM A METAL FLAT PRODUCT

(71) Applicant: SMS GROUP GMBH, Düsseldorf (DE)

(72) Inventors: Frank Werner, Heiligenhaus (DE); Roman Dehmel, Grevenbroich (DE); Olaf Hausmann, Duisburg (DE); Gerhard Horn, Ratingen (DE); Kerstin Spill, Netphen (DE)

(73) Assignee: SMS GROUP GMBH, Düsseldorf (DE)

( * ) Notice: Subject to any disclaimer, the term of this patent is extended or adjusted under 35 U.S.C. 154(b) by 187 days.

(21) Appl. No.: 15/740,966

(22) PCT Filed: Jul. 19, 2016

(86) PCT No.: PCT/EP2016/067142

§ 371 (c)(1),
(2) Date: Dec. 29, 2017

(87) PCT Pub. No.: WO2017/013099

PCT Pub. Date: Jan. 26, 2017

(65) Prior Publication Data

US 2018/0185897 A1 Jul. 5, 2018

(30) Foreign Application Priority Data

Jul. 22, 2015 (DE) ..... 10 2015 213 788.0

(51) Int. Cl.
*B21D 1/02* (2006.01)

(52) U.S. Cl.
CPC ..... *B21D 1/02* (2013.01)

(58) Field of Classification Search
CPC .. B21D 1/02; B21D 3/05; B21B 31/16; B21B 31/20; B21B 31/22; B21B 31/30;
(Continued)

(56) References Cited

U.S. PATENT DOCUMENTS 1,762,292 A * 6/1930 George ..... B21B 31/07 72/248
3,156,288 A 11/1964 Lawson
(Continued)

FOREIGN PATENT DOCUMENTS

CN 86206021 U 11/1987
CN 104379271 A 2/2015
(Continued)

OTHER PUBLICATIONS

English Translation of Korean Office Action Application No. 9-5-2019-011233152, dated Feb. 15, 2019, pp. 1-5.
(Continued)

*Primary Examiner* — Edward T Tolan
*Assistant Examiner* — Jared O Brown
(74) *Attorney, Agent, or Firm* — Lucas & Mercanti, LLP; Klaus P. Stoffel

(57) ABSTRACT

A system and method for removing flatness faults from a metal flat product, in particular a metal sheet or a strip, having multiple straightening rollers arranged on opposite sides of the flat product. In order to simplify and to enable more cost-efficient removal of flatness faults from a metal flat product, at least two cooperating straightening rollers arranged on opposite sides of the flat product each have at least three individually-adjustable partial rollers arranged axially adjacent to one another.

7 Claims, 4 Drawing Sheets

(58) Field of Classification Search
CPC ..... B21B 31/32; B21B 2271/06; B21B 31/26; B21B 37/64
USPC ..... 72/244, 406
See application file for complete search history.

(56) References Cited

U.S. PATENT DOCUMENTS

| | | | | |
|---|---|---|---|---|
| 3,924,431 | A | 12/1975 | Hartkopf | |
| 5,479,806 | A | 1/1996 | Benz | |
| 8,365,565 | B2 | 2/2013 | Noe | |
| 9,126,250 | B2 | 9/2015 | Chazal et al. | |
| 2010/0263424 | A1* | 10/2010 | Madhavan | B21D 11/02 72/166 |
| 2015/0027185 | A1* | 1/2015 | Benner | B21B 38/02 72/8.4 |
| 2015/0143864 | A1* | 5/2015 | Abe | B21D 1/02 72/162 |
| 2016/0354820 | A1* | 12/2016 | Katou | B21F 1/02 |

FOREIGN PATENT DOCUMENTS

| | | | | |
|---|---|---|---|---|
| CN | 104384243 | A | 3/2015 | |
| EP | 2475473 | B1 | 12/2012 | |
| JP | 6195721 | A | 5/1986 | |
| JP | 1986095721 | A | 5/1986 | |
| JP | S61095721 | A | 5/1986 | |
| JP | 2005254268 | A | 9/2005 | |
| JP | 2015509852 | A | 4/2015 | |
| RU | 2118920 | C1 | 9/1998 | |
| RU | 2395359 | C2 | 8/2009 | |
| SU | 528984 | A1 | 9/1976 | |
| SU | 576017 | A1 | 10/1977 | |
| WO | 2013135688 | A1 | 9/2013 | |
| WO | WO-2013135688 | A1 * | 9/2013 | B21D 1/02 |

OTHER PUBLICATIONS

English Translation of Chinese Office Action, Application No. 2016800429476, dated Aug. 2, 2019, 2 Pages.

English Translation of Chinese Office Action,Application No. 2016800429476, SMS Group GMBH, dated Nov. 27, 2018, pp. 1-2.
English Translation of Russian Office Action,Application No. 2017142734/02, dated Dec. 28, 2018, pp. 1-6.

* cited by examiner

SYSTEM AND METHOD FOR REMOVING FLATNESS FAULTS FROM A METAL FLAT PRODUCT

The present application is a 371 of International application PCT/EP2016/067142, filed Jul. 19, 2016, which claims priority of DE 10 2015 213 788.0, filed Jul. 22, 2015, the priority of these applications is hereby claimed and these applications are incorporated herein by reference.

BACKGROUND OF THE INVENTION

The invention relates to a system for removing flatness faults from a metal flat product, in particular a metal sheet or a strip, said system having a plurality of straightening rollers that are disposed on opposite sides of the flat product.

The invention furthermore relates to a method for removing flatness faults from a metal flat product, in particular a metal sheet or a strip, while using a straightening system.

Flatness faults of a metal flat product, for example a metal sheet or a strip, are deviations of the large faces of the flat product from an ideal, in particular planar, target face. The flatness faults can arise in the form of undulations or bulges, for example. The flatness of a flat product is a substantial quality feature of the flat product. Flatness faults are non-uniform elongations and compressions in the material structure of a flat product, said elongations and compressions being created primarily by a rolling process and/or a heat treatment of the flat product. It is known for either roller straightening machines or bending presses to be used for removing flatness faults from flat products.

A continuous straightening process can be carried out by way of roller straightening machines. To this end, a roller straightening machine has a plurality of straightening rollers that are disposed on opposite sides of the flat product to be treated, so as to be able to remove central and peripheral undulations and other flatness faults. A roller straightening machine operates in relation to the length and corrects primarily uni-axial flatness faults in the processing direction of the flat product through the roller straightening machine. The potential for corrections in the direction transverse to said processing direction is only limited.

A discontinuous bending process in which a pressing head in a localized manner exerts a force onto the flat product in order for flatness faults to be corrected can be carried out by way of bending presses. Flatness faults in the multi-axial direction can be corrected on account of the force being exerted in a localized manner. A bending process is associated with high complexity in terms of the positioning of the flat product relative to the pressing head, and on account thereof associated with very low productivity.

WO 2013/135688 A1 discloses a continuously operating device for straightening metal strip. The device comprises a plurality of straightening rollers that are disposed on opposite sides of the metal strip to be straightened. Each straightening roller can be assigned individually actuatable control elements that are disposed beside one another in the transverse direction, by way of which an axial bending profile of the respective straightening roller is capable of being set in order for the straightening procedure to be optimized.

EP 2 475 473 B1 relates to a straightening machine for strip-shaped material, comprising: a rigid lower support from which a multiplicity of vertical columns which are disposed on both sides of a longitudinal sequence axis of the strip-shaped material extend, a lower rigid straightening cartridge, wherein the lower rigid straightening cartridge during the operation of the straightening machine is supported on the rigid support, an upper straightening cartridge, wherein each cartridge comprises a multiplicity of spaced-apart rollers which are mounted so as to rotate in bearings having axes that run perpendicularly to the longitudinal sequence axis of the material. The straightening machine moreover comprises: an upper rigid support which is connected to the vertical columns and is fastened in a stable manner to the upper end of each column, movable means for fastening the upper straightening cartridge to the upper support, said means permitting the mobility of the upper straightening cassette, means for moving the upper straightening cassette in a translatory vertical manner in relation to the upper rigid support between a resting position in which the rollers of the upper straightening cartridge are remote from the rollers of the lower straightening cartridge, and a straightening position in which the rollers of the upper straightening cartridge are moved to the rollers of the lower straightening cartridge so as to predefine an undulated path for the strip, wherein the means for moving are suitable for equalizing the flexing of the upper straightening cartridge that is caused by the separation force effected by the passage of the strip to be straightened.

U.S. Pat. No. 3,156,288 A discloses a straightening machine having a means for tilting worker rollers in the longitudinal direction (conveying direction through the straightening machine) and/or in the transverse direction, wherein the worker rollers have two collaborating wedge elements which are rotatable relative to one another. An upper roller assembly comprises worker rollers which are disposed on a frame and are supported in holders by way of rollers. The spacing between the upper roller assembly and a lower roller assembly which comprises worker rollers and support rollers is set by way of a hand wheel which by way of connecting rods and a gearbox drives jack screws so as to lift or lower a transverse head that supports the upper roller assembly. The upper worker rollers are set by setting the support rollers by way of an activation of the hand wheel.

SUMMARY OF THE INVENTION

It is an object of the invention to add flexibility to the removal of flatness faults from a metal flat product, in particular a metal sheet or a strip, and to simplify said removal of flatness faults and to enable the latter to be more cost-effective.

A system according to the invention for removing flatness faults from a metal flat product, in particular a metal sheet or a strip, comprises a plurality of straightening rollers that are disposed on opposite sides of the flat product, wherein at least two interacting straightening rollers that are disposed on opposite sides of the flat product have in each case at least three individually adjustable part-rollers that are disposed so as to be axially neighboring one another.

On account of the straightening rollers being split into individually adjustable part-rollers it is possible, on the one hand, for the part-rollers to be adjusted in such a manner that the respective straightening roller corresponds substantially to a conventional integrally configured straightening roller. On account thereof, a continuous straightening procedure by way of which in particular uni-axial flatness faults of the flat stock in the processing direction are correctable can be carried out by way of the system according to the invention. Alternatively, discontinuous bend-pressing in which the individual part-rollers are capable of being used as pressing heads so as to be able to correct multi-axial flatness faults of the flat product can be carried out on account of a targeted individual adjustment of the part-rollers by way of the system according to the invention. Furthermore alternatively, in particular continuous combined straightening and bend-pressing during a single pass of the flat stock through the system can be carried out on account of a targeted individual adjustment of the part-rollers by way of the system according to the invention. The part-rollers herein can also act like pressing heads in the transverse direction and by way of a superimposed adjustment can simultaneously assume a conventional straightening function. The part-rollers in the case of these three different operating modes of the system according to the invention act directly on the flat product. On account of the individual adjustment of each part-roller being influenced in a targeted manner, the force that can be generated by way of the respective part-roller as well as an inclined position of the respective part-roller in relation to the longitudinal central axis of the respective straightening roller can be adjusted. In particular, the respective part-roller can be actuated like a pressing tool of a bending press, in order for local, in particular multi-axial, flatness faults of the flat product to be corrected.

Straightening and bend-pressing can be carried out by means of a single system according to the invention. Conventionally, two separate systems are required to this end, specifically one system for straightening and one system for bend-pressing. Consequently, in conventional terms, either press-bending in multiple axes is carried out in a discontinuous operation of a bend-pressing system, or uni-axial straightening is carried out in a continuous operation of a straightening system. In order for an optimal flatness of flat products to be established conventionally, at least two different types of systems have thus to be made available, both types of systems not always being completely utilized. This leads to high investment costs for the two systems and to correspondingly high operating costs. By contrast, according to the invention only a single system according to the invention has to be made available, this being associated with a significant reduction in investment costs and operating costs.

Since in conventional terms at least two different types of systems for removing flatness faults from flat products are present, it is necessary for a flat product to be moved from one system to the other system. The frequent handling procedures associated therewith for moving the flat products have the additional risk of flatness faults, for example surface defects, arising, this in the production of flat products being associated with substandard quality. This can also be reliably avoided by way of the invention, since corresponding handling procedures for moving the flat products between different systems are not required.

The system according to the invention can also comprise three or a plurality of straightening rollers which in each case have at least three individually adjustable part-rollers that are disposed so as to be axially neighboring one another. Such a straightening roller can also have four or a plurality of individually adjustable part-rollers that are disposed so as to be axially neighboring one another.

According to one advantageous design embodiment, the part-rollers of each straightening roller are in each case actively adjustable by way of at least one dedicated adjustment unit. To this end, the adjustment units are configured so as to each be actuatable, in particular in an individual manner. The respective part-roller by way of such an adjustment unit can also in particular be adjusted so as to be inclined to the longitudinal central axis of the respective straightening roller. A combination of force regulation and position regulation can be used herein. The adjustment units that are assigned to the part-rollers of a straightening roller can be collectively adjusted by way of a common adjustment unit, this being advantageous in particular in terms of the actuation complexity for a sole straightening procedure.

At least one adjustment unit advantageously comprises at least one mechanical, electromechanical, pneumatic, or hydraulic actuator. At least one adjustment unit can also have a combination of at least two of these variants of actuators.

According to a further advantageous design embodiment, at least the adjustment units that are assigned to the axially external part-rollers of one of the two straightening rollers have in each case at least one pivot unit by way of which the respective part-roller is passively adjustable so as to be inclined to the longitudinal axis of this straightening roller. On account thereof, the inclined position of the respective external part-roller can be passively adapted to the bending line set by the actively adjustable part-roller on the opposite side of the flat product that interacts with said external part-roller, without any active actuation being required to this end. The actuation complexity is reduced on account thereof. The pivot unit can enable pivoting of the respective part-roller about an axis that runs in the processing direction of the flat product. Additionally, the pivot unit can enable pivoting of the respective part-roller about an axis that runs transversely to the processing direction. The pivot unit can be configured in such a manner that in the case of pivoting of the respective part-roller a restoring force by way of which the part-roller is impingeable with a force in the direction of the non-pivoted position of said part-roller is generated by said part-roller. In particular, support by way of the edges on the flat product and surface damage to the flat product on account of the contact between the end portion of the part-roller and the flat product can be reliably avoided by way of the pivot unit.

It is furthermore advantageous for at least one adjustment unit to have at least one wedge lifting unit. On account thereof, the part-roller that is assigned to the adjustment unit is adjustable in a continuous and very precise manner. The wedge lifting unit comprises two wedges having wedge faces that are disposed in a reciprocating manner and are guidable past one another, the adjustment of the part-roller being performed by the relative movements of said wedge faces.

A further advantageous design embodiment provides that at least one part-roller at least at one axial end portion is provided with an external diameter reduction. On account thereof, support by way of the edges and damage to the surfaces of the flat product by contact between the end portion of the part-roller and the flat product can be reliably avoided. Moreover, the bending function of the part-roller is intensified. The external diameter reduction can be established, for example, by tangential grinding of an encircling radius on the end portion of the part-roller.

According to a further advantageous design embodiment, the interacting straightening rollers that comprise the part-rollers are disposed so as to be mutually offset or not mutually offset in relation to a processing direction of the flat product through the system. The interacting straightening rollers that comprise the part-rollers in terms of the processing direction of the flat product through the system can be disposed between conventional continuous straightening rollers. Alternatively, the interacting straightening rollers that comprise the part-rollers in terms of the processing direction of the flat product through the system can be disposed upstream or downstream of conventional straightening rollers. If the interacting straightening rollers that comprise the part-rollers in terms of a processing direction of the flat product through the system are not disposed so as to be mutually offset, traction-dominated stress states in relation to the conventional straightening rollers of the system can be built up by way of drives of said former straightening rollers.

According to a further advantageous design embodiment, the system has at least one electronic controlling and/or regulating circuit that in terms of signaling is connectable to the adjustment units and is specified for actuating the adjustment units in a manner dependent on the respective quality and position of the flatness faults of the flat product such that straightening, bend-pressing, or combined straightening and bend-pressing can be selectively carried out by way of the system. The respective quality and position of the flatness faults can be determined in advance. This can be performed in the course of an automated acquisition of measured values or of a manual acquisition of measured values, or in a simple manner by way of the experienced eye of an operator. Items of quality information from a production planning and control system can also be considered.

The electronic controlling and/or regulating circuit can select the respective operating mode of the system while considering items of information or parameters, respectively, and evaluation criteria by way of the respective fault type. The selection can alternatively be performed by the operator. In the operating mode "straightening" the part-rollers of a straightening roller are synchronous and act as a continuous straightening roller. Alternatively, the use of the part-rollers or of the correspondingly designed straightening rollers, respectively, can be dispensed with in the operating mode "straightening". By way of the operating mode "straightening" the flatness of the flat product is improved only in a uni-axial direction, as is the case in a conventional roller straightening machine. In the operating mode "bend-pressing" an isolated operation of the straightening rollers that comprise the part-rollers is performed according to a conventional bending press. Local, multi-axial flatness faults of the flat stock are corrected herein. In the operating mode "combined straightening and bend-pressing" multi-axial straightening is performed in a single production step. The straightening rollers that comprise the part-rollers and the conventional straightening rollers herein operate simultaneously in removing the flatness faults of the flat product. If this is required by the quality of the local flatness faults of the flat stock, the operating mode "bend-pressing" can be selected during a first pass of the flat product through the system. Subsequently, or after this local flatness fault has been largely removed, respectively, the operating mode "straightening" or "combined straightening and bend-pressing" can be selected during a further pass of the flat product through the system. In order for an optimal flatness result to be achieved, a number of adjustment units which can be actuated by way of nominal values of a regulating circuit is available both for the straightening rollers that comprise the part-rollers as well as for the continuous straightening rollers. The selection of the respective operating mode of the system decides which adjustment units have to be actuated. The distribution of individual flatness faults of the flat product determined among the individual adjustment units can be performed while using a straightening model.

The system advantageously comprises at least one detection installation for detecting a quality and position of the flatness faults of the flat product that is to be treated by way of the system or is being treated by way of the system, said detection installation in terms of signaling being connectable to the electronic controlling and/or regulating circuit. On account thereof, a subjective evaluation of flatness can be replaced by an objective evaluation of flatness by way of the electronic control and/or regulating circuit. The detection of the quality and position of the flatness faults of the flat product to be treated by way of the system at the entry side, this being likewise required for the selection of the respective operating mode of the system, serves for presetting the system (feed-forward regulation). By way of the detection of the quality and position of the flatness faults of the flat product that is being treated by way of the system at the exit side, any potentially required subsequent straightening actions can be provided with a modified setup (feet-backward regulation).

According to a method according to the invention for removing flatness faults from a metal flat product, in particular a metal sheet or a strip, while using a straightening system, bend-pressing, or combined straightening and bend-pressing is carried out by way of the straightening system.

The advantages mentioned above in the context of the system are associated in an analogous manner with the method. In particular, a system according to one of the aforementioned design embodiments or according to an arbitrary combination thereof can be used as the straightening system.

The invention will be explained hereunder in an exemplary manner by means of preferred embodiments with reference to the appended figures, wherein the features illustrated hereunder, individually or in various combinations, can in each case represent an aspect of the invention.

DETAILED DESCRIPTION OF THE INVENTION

Same components or components with equivalent functions, respectively, are provided with the same reference signs in the figures.

Figure 1:
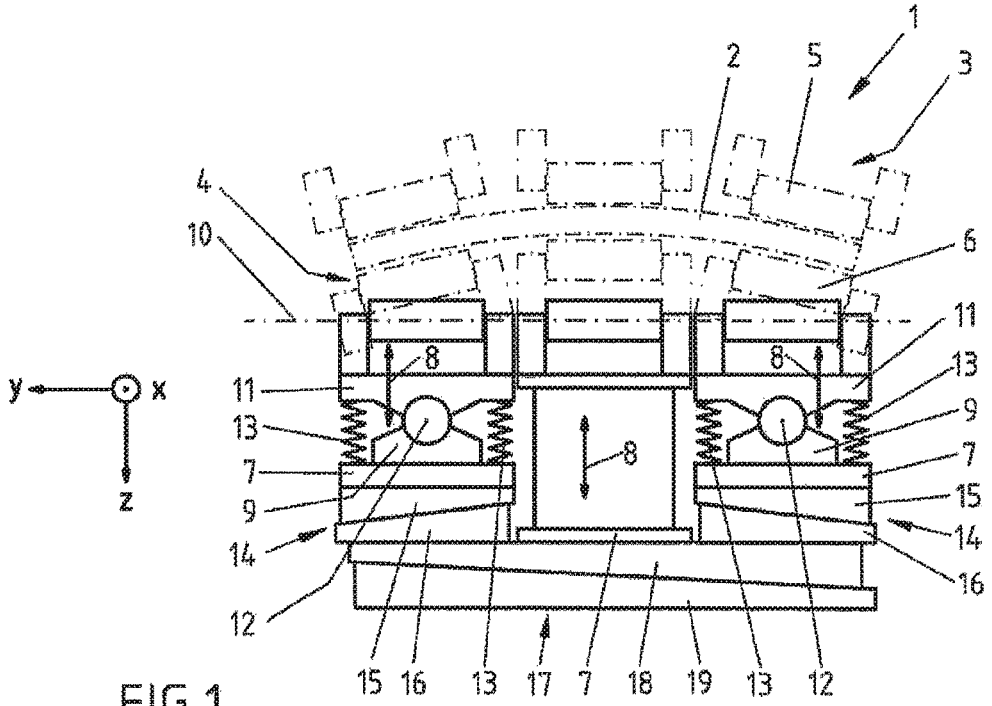
FIG. 1 shows a schematic illustration of an exemplary embodiment for a system according to the invention in a first system state.
Figure 2:
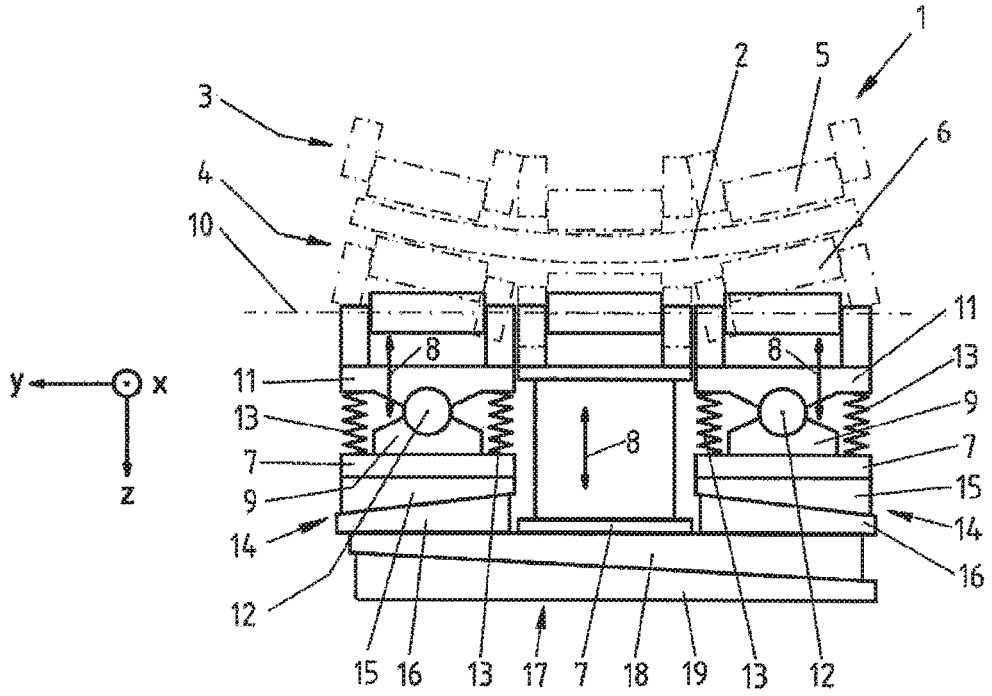
FIG. 2 shows a schematic illustration of the system shown in FIG. 1 in a further system state.

FIGS. 1 and 2 schematically show potential convex or concave straightening gap geometries, respectively, for removing flatness faults of a non-flat metal flat product 2, in particular of a metal sheet or of a strip.

The system 1 comprises a plurality of straightening rollers 3 and 4 that are disposed on opposite sides of the flat product 2, of which only two are shown in FIG. 1. The interacting straightening rollers 3 and 4 shown have in each case three individually adjustable part-rollers 5 or 6, respectively, that are disposed so as to be axially neighboring one another. The part-rollers 5 or 6, respectively, of each straightening roller 3 or 4, respectively, are in each case actively adjustable by way of at least one dedicated adjustment unit 7, in a manner corresponding to the double arrows 8. Only the adjustment units 7 for adjusting the part-rollers 6 are shown in FIG. 1. At least one adjustment unit 7 can have at least one mechanical, electromechanical, pneumatic, or hydraulic actuator (not shown). The part-rollers 6 in solid lines are shown in a state in which the actuators are not active. At least one part-roller 5 or 6, respectively, at least at one axial end portion can be provided with an external diameter reduction (not shown). The interacting straightening rollers 3 or 4, respectively, that comprise the part-rollers 5 or 6, respectively, can be disposed so as to be mutually offset or not mutually offset in relation to a processing direction x of the flat product 2 through the system 1.

The adjustment units 7 that are assigned to the axially external part-rollers 6 of the straightening roller 4 have in each case one pivot unit 9 by way of which the respective part-roller 6 is passively adjustable so as to be inclined to the longitudinal central axis 10 of the straightening roller 4, as is shown in FIG. 1. Each pivot unit 9 comprises a rocker 11 which is mounted so as to be pivotable about an axle 12 that is aligned so as to be parallel with the processing direction x of the flat product 2 through the system 1. Each pivot unit 9 furthermore comprises two compression springs 13 which, when the rocker 11 is pivoted from the position shown, in each case generate a restoring force by way of which the rocker 11 is impinged with a force in the direction of the position shown.

The adjustment units 7 that are assigned to the axially external part-rollers 6 have in each case one wedge lifting unit 14 having two wedges 15 and 16, the respective adjustment of the respective part-roller 6 being defined by the relative position of said wedges 15 and 16. The adjustment units 7 are collectively adjustable by way of a common adjustment unit 17 which has a wedge lifting system that is formed by the wedges 18 and 19.

The system 1 comprises an electronic controlling and/or regulating circuit (not shown) which in terms of signaling is connectable to the adjustment units 7 and is specified for actuating the adjustment units 7 in a manner dependent on the respective quality and position of the flatness faults of the metal flat product 2 such that straightening, bend-pressing, or combined straightening and bend-pressing can be selectively carried out by way of the system 1.

The system 1 can furthermore have at least one detection installation (not shown) for detecting a quality and position of the flatness faults of the flat product 2 that is to be treated by way of the system 1 or is being treated by way of the system 1, said detection installation in terms of signaling being connectable to the electronic controlling and/or regulating circuit.

Figure 3:
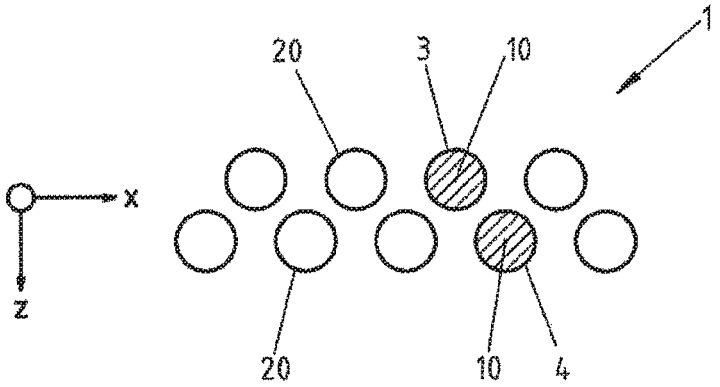
FIG. 3 shows a schematic illustration of a further exemplary embodiment for a system according to the invention.
Figure 4:
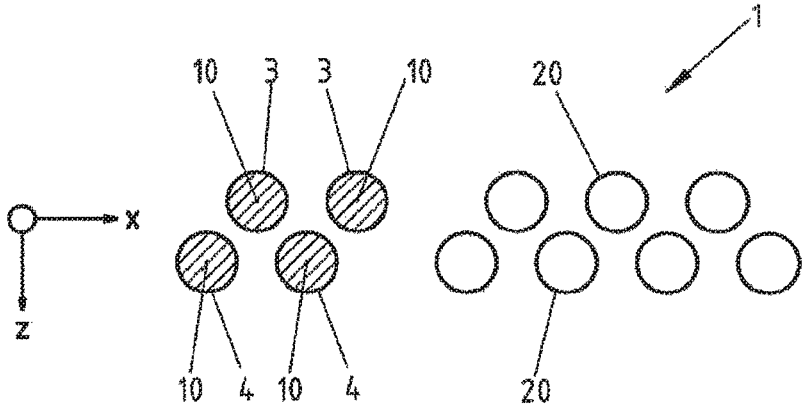
FIG. 4 shows a schematic illustration of a further exemplary embodiment for a system according to the invention.
Figure 5:
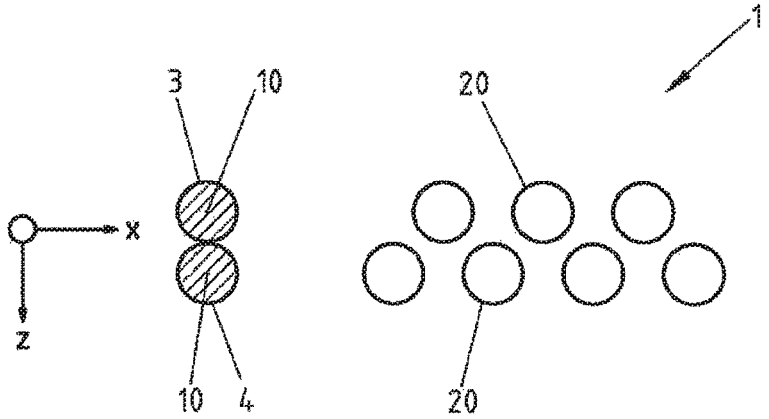
FIG. 5 shows a schematic illustration of a further exemplary embodiment for a system according to the invention.

FIGS. 3 to 5 show potential ways of integrating the split straightening rollers (bend-pressing function) in or on, respectively, a conventional roller straightening machine (straightening function). The system 1 comprises a plurality of straightening rollers 3, 4, and 20 that are disposed on opposite sides of the flat product.

Two interacting straightening rollers 3 and 4 that are disposed on opposite sides of the metal flat product have in each case at least three individually adjustable part-rollers (not shown) that are disposed so as to be axially neighboring one another. The part-rollers of each straightening roller 3 and 4 are in each case actively adjustable by way of at least one dedicated adjustment unit (not shown). At least one adjustment unit comprises at least one mechanical, electromechanical, pneumatic, or hydraulic actuator. At least those adjustment units that are assigned to the axially external part-rollers of one of the two straightening rollers 3 or 4, respectively, can in each case have at least one pivot unit (not shown) by way of which the respective part-roller is passively adjustable so as to be inclined to the longitudinal central axis 10 of this straightening roller 3 or 4, respectively. At least one adjustment unit can have at least one wedge lifting unit (not shown). At least one part-roller at least one axial end portion can be provided with an external diameter reduction (not shown). These components of the system 1 can be configured so as to correspond to FIGS. 1 and 2, for example, for which reason reference is made here to the description above pertaining to FIGS. 1 and 2.

The interacting straightening rollers 3 and 4 that comprise the part-rollers are disposed so as to be mutually offset in relation to a processing direction x of the flat product through the system 1. The remaining straightening rollers 20 are also disposed so as to be correspondingly mutually offset and so as to be offset in relation to the straightening rollers 3 and 4.

The system 1 comprises an electronic controlling and/or regulating circuit (not shown) that in terms of signaling is connectable to the adjustment units and is specified for actuating the adjustment units in a manner dependent on the respective quality and position of the flatness faults of the metal flat product such that straightening, bend-pressing, or combined straightening and bend-pressing can be selectively carried out by way of the system 1.

The system 1 can furthermore have at least one detection installation (not shown) for detecting a quality and position of the flatness faults of the metal flat product that is to be treated by way of the system 1 or is being treated by way of the system 1, said detection installation in terms of signaling being connectable to the electronic controlling and/or regulating circuit.

FIG. 4 shows a schematic illustration of a further exemplary embodiment for a system 1 according to the invention for removing flatness faults from a metal flat product (not shown), in particular a metal sheet or a strip. This system 1 differs from the exemplary embodiment shown in FIG. 3 in that four straightening rollers 3 and 4 which in each case have at least three individually adjustable part-rollers (not shown) that are disposed so as to be axially neighboring one another are present, and in that these straightening rollers 3 and 4 in relation to the processing direction x of the metal flat product through the system 1 are disposed upstream or downstream, respectively, of a conventional roller straightening unit that is formed by the straightening rollers 20. The system 1 otherwise corresponds to the exemplary embodiment shown in FIG. 3, for which reason reference is made here to the above description of FIG. 3 in order to avoid repetitions.

FIG. 5 shows a schematic illustration of a further exemplary embodiment for a system 1 according to the invention for removing flatness faults from a metal flat product (not shown), in particular a metal sheet or a strip. This system 1 differs from the exemplary embodiment shown in FIG. 4 in that only two interacting straightening rollers 3 and 4 which in each case have at least three individually adjustable part-rollers (not shown) that are disposed so as to be axially neighboring one another and in relation to the processing direction x of the metal flat product through the system 1 are disposed upstream or downstream, respectively, of the straightening rollers 20 are present, and in that the straightening rollers 3 and 4 are not disposed so as to be mutually offset in relation to the processing direction x of the metal flat product through the system 1. The system 1 otherwise corresponds to the exemplary embodiment shown in FIG. 3, for which reason reference is made here to the above description of FIG. 3 in order to avoid repetitions.

Figure 6:
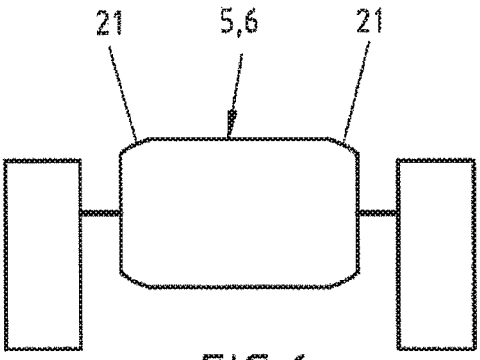
FIG. 6 shows a schematic illustration of a part-roller of a further exemplary embodiment for a system according to the invention.

FIG. 6 shows a schematic illustration of a part-roller 5 or 6, respectively of a further exemplary embodiment for a system according to the invention for removing flatness faults from a metal flat product (not shown), in particular a metal sheet or a strip. The part-roller 5 or 6, respectively, can be used in one of the systems shown in FIGS. 1 to 5. The part-roller 5 or 6, respectively, at both axial end portions is in each case provided with one external diameter reduction 21 in the form of a radius, in order for metal sheet surface faults on account of support by way of the edges to be minimized.

Figure 7:
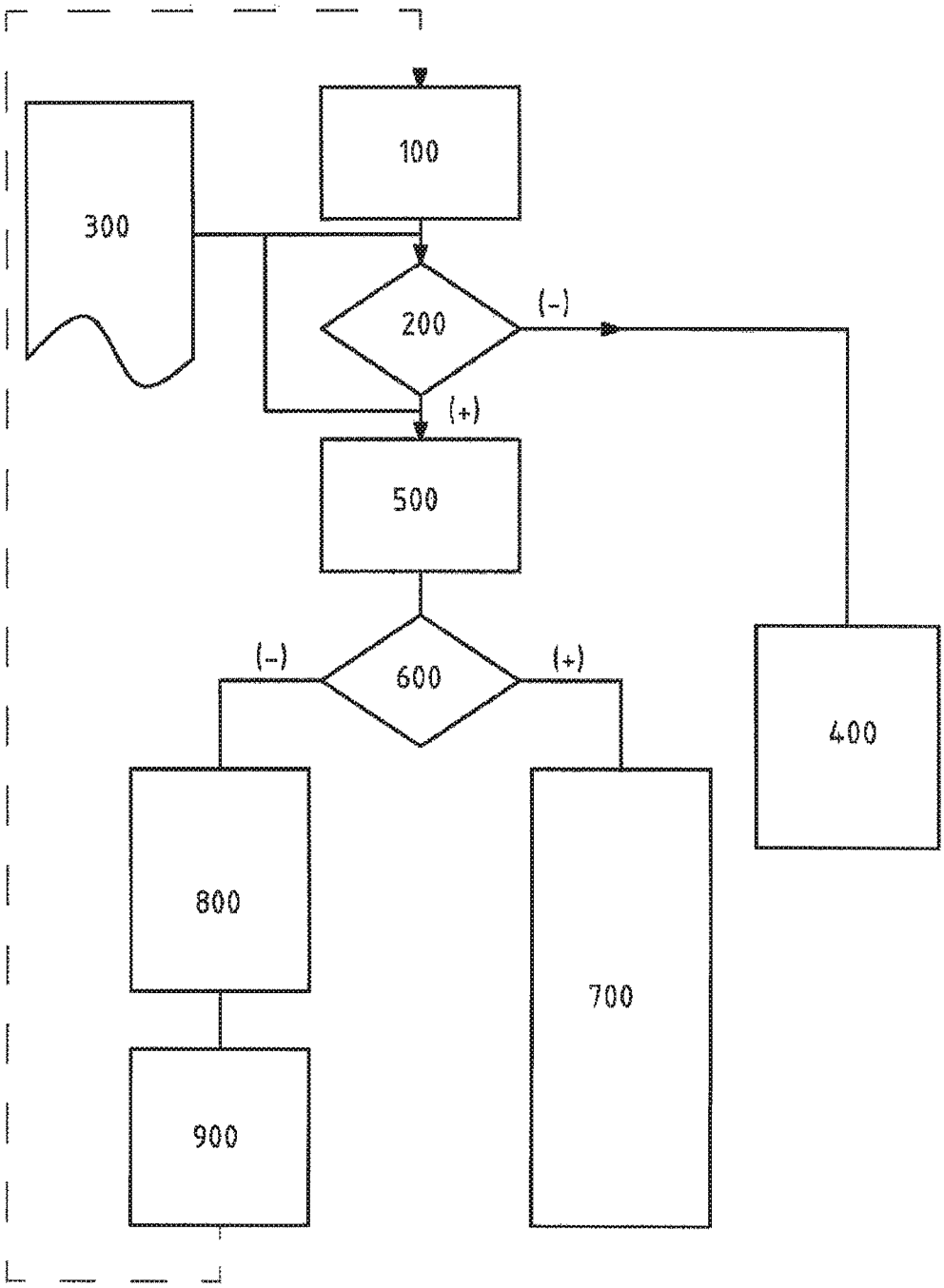
FIG. 7 shows a schematic illustration of an exemplary embodiment for a method according to the invention.

FIG. 7 shows a schematic illustration of an exemplary embodiment for a method according to the invention for removing flatness faults from a metal flat product (not shown), in particular a metal sheet or a strip, while using a straightening system (not shown) by way of which straightening, bend-pressing, or combined straightening and bend-pressing can be selectively carried out. The straightening system can be configured according to one of the exemplary embodiments shown in FIGS. 1 to 6.

Data pertaining to the flatness of the metal flat product that is to be treated by way of the straightening system is acquired in step 100. In step 200 it is determined whether bend-pressing is required in order for flatness faults of the metal flat product to be removed. Items of information 300 in the form of parameters or evaluation criteria of flatness faults, respectively, are considered herein, in particular whether said flatness faults are peripheral undulations, central undulations, hemispheres, or the like. These items of information 300 can be sourced from tables, process models, or by way of visual detection by an operator. If step 200 results in no bend-pressing (−) being required, the operating mode "straightening" in which uni-axial straightening of the metal flat product by means of the straightening system is performed is initiated in step 400. Herein, straightening rollers that comprise part-rollers can be operated as continuous straightening rollers or be excluded from the straightening process. If step 200 results in bend-pressing (+) being required, the required deformation complexity is calculated in step 500. It is subsequently determined in step 600 whether or not the quality of the flatness faults is such that the flatness faults are correctable in a single pass of the metal flat product through the straightening system. If step 600 results in the flatness faults being correctable in a single pass of the metal flat product through the straightening system (+), the operating mode "combined straightening and bend-pressing" is initiated in step 700. Herein, the straightening rollers that comprise the part-rollers are used for correcting multi-axial flatness faults, for example hemispheres, and the continuous straightening rollers without part-rollers are used for correcting undulations. The straightening rollers that comprise the part-rollers can be actuated in a superimposed manner and, on account thereof, can be simultaneously used for correcting undulations. If step 600 results in the flatness faults not being correctable in a single pass of the metal flat product through the straightening system (−), the operating mode "bend-pressing" is initiated in step 800. Herein, multi-axial flatness faults are corrected by means of the straightening rollers that comprise the part-rollers. It is subsequently determined in step 900 whether further treatment of the metal flat product is required for removing flatness faults. Should this be the case, step 100 is chosen.

Figure 8:
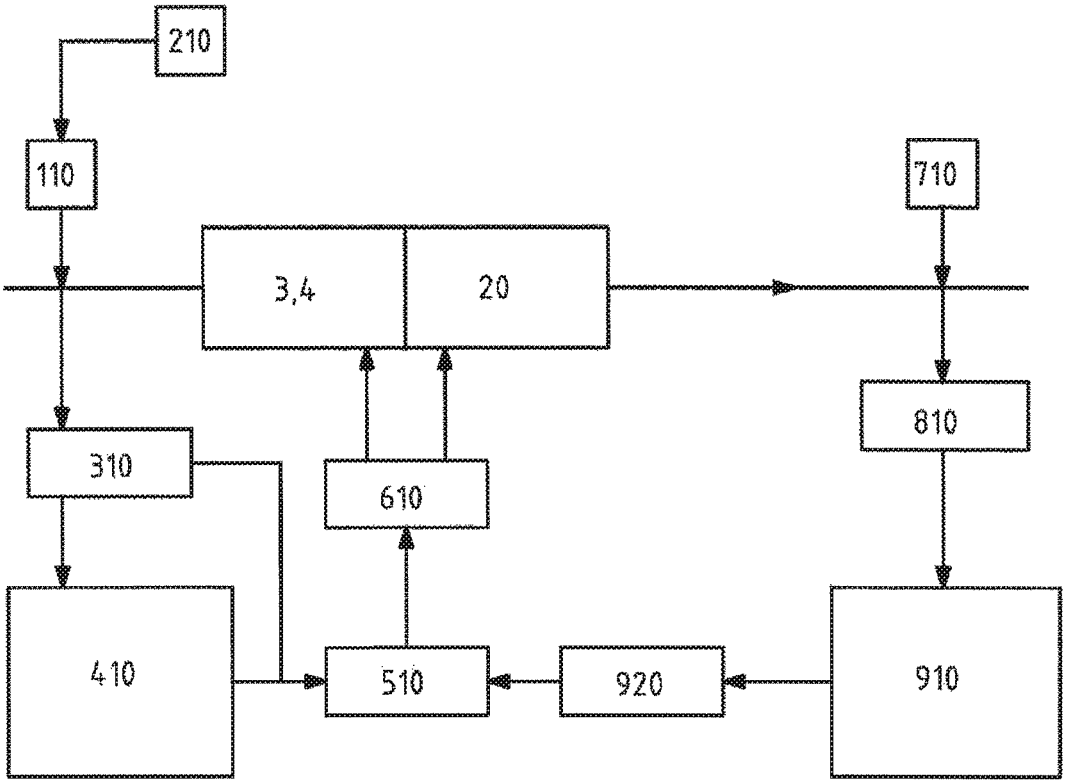
FIG. 8 shows a schematic detailed illustration of an exemplary embodiment for a regulating concept for a system according to the invention.

FIG. 8 shows a schematic detailed illustration of an exemplary embodiment for a regulation concept for a system according to the invention for removing flatness faults from a metal flat product (not shown), in particular a metal sheet or a strip, in the case of a given operating mode of the system.

Detection of flatness faults of the metal flat product at the entry side is performed in step 110. Data 210 from a hot rolling mill, from a visual inspection, or from measuring the flatness of the metal flat product can be supplied to step 110. The flatness data is generated in step 310. The flatness data is subjected to a flatness fault analysis in step 410. The position of the respective flatness fault in the width direction and the length direction of the metal flat product, and the depth of the respective flatness fault are determined herein. The data from step 410, or selectively the data from step 310 in the context of a feed-forward regulation, are supplied to a system controller and/or regulator 510, so as to establish a system setup. The system controller and/or regulator 510 thereupon generates control signals 610 for actuating the adjustment units of the straightening rollers 3, 4, or 20 of the system.

Detection of flatness faults of the metal flat product can be performed at the exit side in step 710. The measured values 810 resulting therefrom are subjected to a flatness fault analysis in step 910. The position of the respective flatness fault in the width direction and the length direction of the metal flat product, and the depth of the respective flatness fault are determined herein. At least one correction value which is supplied to the system controller and/or regulator 510 is determined in step 920.

LIST OF REFERENCE SIGNS

1 System
2 Flat product
3 Straightening roller
4 Straightening roller
5 Part-roller
6 Part-roller
7 Adjustment unit
8 Adjustment direction
9 Pivot unit
10 Longitudinal central axis
11 Rocker
12 Axle
13 Compression spring
14 Wedge lifting unit
15 Wedge
16 Wedge
17 Common adjustment unit
18 Wedge
19 Wedge
20 Straightening roller
21 External diameter reduction
100 Step
110 Step
200 Step
210 Data
300 Items of information
310 Step
400 Step
410 Step
500 Step
510 System controller and/or regulator
600 Step
610 Control signals

700 Step
710 Step
800 Step
810 Measured value
900 Step
910 Step
920 Step
x Processing direction

The invention claimed is:

1. A system for removing flatness faults from a metal flat product, the system comprising: a plurality of straightening rollers disposed on opposite sides of the flat product, wherein at least two interacting rollers of the plurality of straightening rollers that are disposed on opposite sides of the flat product have in each case at least three individually adjustable part-rollers that are disposed so as to be axially neighboring one another; and a plurality of adjustment units, a respective one of the plurality of adjustment units being dedicated to a respective one of the part-rollers of each straightening roller, the adjustment units being configured to actively adjust positions of the respective part-rollers, wherein the plurality of adjustment units includes adjustment units that are assigned to axially external part-rollers of one of the two interacting straightening rollers, wherein at least the adjustment units assigned to the axially external part-rollers each have at least one pivot unit by which the respective part-roller is passively adjustable so as to be inclined to a longitudinal central axis of the one of the two straightening rollers, wherein the at least one pivot unit includes a rocker pivotable about an axle that is parallel to a processing direction of the flat product, and wherein the at least one pivot unit further includes compression springs arranged so as to act on the rocker so that when the rocker pivots from a first position the springs generate a restoring force to urge the rocker back to the first position.

2. The system according to claim 1, wherein at least one of the adjustment units has at least one mechanical, electromechanical, pneumatic, or hydraulic actuator.

3. The system according to claim 1, wherein at least one of the adjustment units has at least one wedge lifting unit.

4. The system according to claim 1, wherein at least one of the part-rollers at least at one axial end portion has an external diameter reduction.

5. The system according to claim 1, wherein the interacting straightening rollers that comprise the part-rollers are disposed so as to be mutually offset or not mutually offset in relation to a processing direction of the flat product through the system.

6. The system according to claim 1, further comprising at least one electronic controlling and/or regulating system that in terms of signaling is connected to the adjustment units and arranged for actuating the adjustment units dependent on a respective quality and position of the flatness faults of the flat product so that straightening, bend-pressing, or combined straightening and bend-pressing is selectively carried out.

7. A method for removing flatness faults from a metal flat product, comprising the steps of carrying out bend-pressing, or combined straightening and bend-pressing using the straightening system according to claim 1.

* * * * *